US012601564B2

(12) United States Patent
Rocca

(10) Patent No.: US 12,601,564 B2
(45) Date of Patent: Apr. 14, 2026

(54) ALIGNMENT GUIDANCE SYSTEM

(71) Applicant: Christopher Rocca, Shamong, NJ (US)

(72) Inventor: Christopher Rocca, Shamong, NJ (US)

( * ) Notice: Subject to any disclaimer, the term of this patent is extended or adjusted under 35 U.S.C. 154(b) by 58 days.

(21) Appl. No.: 18/703,514

(22) PCT Filed: Oct. 26, 2022

(86) PCT No.: PCT/US2022/047832

§ 371 (c)(1),
(2) Date: Apr. 22, 2024

(87) PCT Pub. No.: WO2023/204843

PCT Pub. Date: Oct. 26, 2023

(65) Prior Publication Data

US 2025/0237478 A1 Jul. 24, 2025

Related U.S. Application Data

(60) Provisional application No. 63/271,807, filed on Oct. 26, 2021.

(51) Int. Cl.

| | |
|---|---|
| ***F41G 1/12*** | (2006.01) |
| ***F41G 1/08*** | (2006.01) |
| ***F41G 1/34*** | (2006.01) |

(52) U.S. Cl.

CPC ..... *F41G 1/12* (2013.01); *F41G 1/08* (2013.01); *F41G 1/345* (2013.01)

(58) Field of Classification Search

CPC ..... F41G 1/12; F41G 1/08; F41G 1/345
USPC ..... 42/132
See application file for complete search history.

(56) References Cited

U.S. PATENT DOCUMENTS

| | | | | |
|---|---|---|---|---|
| 1,406,620 | A * | 2/1922 | Dear | F41G 1/01 42/142 |
| 3,698,092 | A * | 10/1972 | Rosenhan | F41G 1/345 42/132 |
| 5,327,654 | A | 7/1994 | Parker | |
| 5,481,807 | A * | 1/1996 | Ploot | F41G 1/467 124/87 |
| 5,822,872 | A * | 10/1998 | Waki | F41G 1/12 42/141 |
| 9,285,186 | B1 * | 3/2016 | Di Veroli | F41G 1/32 |
| 9,835,411 | B2 * | 12/2017 | Larson, Jr. | F41G 1/17 |

(Continued)

FOREIGN PATENT DOCUMENTS

| | | | | |
|---|---|---|---|---|
| EP | 3943872 | A1 * | 1/2022 | F41G 1/06 |
| GB | 191511682 | A | 8/1916 | |

OTHER PUBLICATIONS

International Search Report in International Application No. PCT/US2022/047832, mailed Nov. 8, 2023.

(Continued)

*Primary Examiner* — Samir Abdosh
(74) *Attorney, Agent, or Firm* — Kim IP Law Group LLC

(57) ABSTRACT

A combined sight and optic sight mount securable to an upper surface of a firearm comprising: an aperture frame including: a stationary aft aperture frame; and a movable aft aperture sub-frame situated within the stationary aft aperture frame and comprising: opposed vertical sidewalls, a top wall connecting the opposed vertical sidewalls, and a pair of substantially horizontal planar aiming reference members extending inwardly from the vertical sidewalls and defining a gap therebetween.

17 Claims, 7 Drawing Sheets

(56) References Cited

U.S. PATENT DOCUMENTS

| | | | | |
|---|---|---|---|---|
| 10,612,889 | B1 | 4/2020 | Wyka | |
| 10,663,254 | B1 | 5/2020 | Molcho | |
| 2003/0136012 | A1* | 7/2003 | Walbrink | F41G 1/467 33/265 |
| 2004/0025398 | A1 | 2/2004 | Howe | |
| 2011/0005119 | A1* | 1/2011 | Neergaard | F41G 1/08 42/111 |
| 2013/0263492 | A1 | 10/2013 | Erdle | |
| 2016/0223292 | A1* | 8/2016 | Pulit, Jr. | F41G 1/26 |
| 2017/0219313 | A1* | 8/2017 | Howe | F41G 1/01 |
| 2018/0202770 | A1* | 7/2018 | Pniel | F41G 1/16 |
| 2019/0226803 | A1* | 7/2019 | Noonan | F41G 1/26 |
| 2022/0390207 | A1* | 12/2022 | Chavez | F41G 1/01 |
| 2024/0418480 | A1* | 12/2024 | Doering | F41G 1/08 |

OTHER PUBLICATIONS

Written Opinion of the International Search Report in International Application No. PCT/US2022/047832, mailed Nov. 8, 2023.

European Patent Office, Extended European Search Report issued in related European Patent Application No. 1 22 938 716.2, dated Oct. 15, 2025.

* cited by examiner

ALIGNMENT GUIDANCE SYSTEM

CROSS-REFERENCE TO RELATED APPLICATION(S)

This is a national stage application filed under 35 U.S.C. § 371 based on International Patent Application No. PCT/US2022/047832, filed Oct. 26, 2022, which claims priority to U.S. Patent Application No. 63/271,807, filed Oct. 26, 2021, the disclosures of which are incorporated herein by reference in their entireties.

FIELD OF THE INVENTION

The exemplary embodiments of the present invention relate generally to an alignment guidance system for a conventional firearm, e.g., rifle, shotgun or pistol, that assists an operator in accurately shooting a target with the firearm.

BACKGROUND OF THE INVENTION

Conventional sighting systems i.e., alignment guidance systems, for firearms generally consist of iron sights or red dot sights. Iron sights for firearms almost entirely consist of some form of notched rear sight that is used to align with a front sight post. In order to aim a firearm with an iron sight, the front sight post is centered laterally in the rear sight notch, and the top of the front sight post is aligned horizontally with the top of the sides of the notched rear sight. Although simple, firearms with iron sights are difficult to accurately shoot as they result in most of an intended target being obscured by the sights themselves and the firearm, while also providing very few reference points for intuitive aiming.

Alternatively, another form of iron sights are ghost ring sights that are often used with shotguns and a limited number of pistols. Ghost ring sights typically consist of a round ring rear sight in which a front sight post is centered. Ghost ring sights allow for quick aiming but lack precision because a user must estimate where the middle of the round ring is positioned while simultaneously attempting to center the front sight post.

Red dot sights used for firearms such as rifles and pistols usually consist of a circular or square housing with at least one glass lens located within the housing upon which a red dot is projected. In order to operate a firearm with a red dot sight, a user needs to align the red dot with an intended target and fire. As a result, firearms utilizing a red dot sight are easier to accurately shoot. That is, when a user looks through the housing, a reference is provided that can be easily used to frame the intended target. However, red dot sights are relatively large and heavy. Additionally, they contain electronics and batteries that are susceptible to failing. Moreover, they utilize glass or plastic lenses (optics) that can crack, scratch, be obscured by rain or condensation, and typically suffer from color distortion due to lens materials and coatings. Further, unless users undergo rigorous training with red dot sights, they will often suffer from "losing the dot," wherein the user is unable to position their head/eye in the correct location to visualize the dot. In other words, the user often loses alignment of the red dot relative to the horizontal, vertical and longitudinal axes of the firearm. As a result, additional time is spent adjusting the head and/or the firearm to reacquire and properly align the red dot.

Furthermore, modern rifles typically use an electronic red dot sight or a scope as their primary optic. For redundancy purposes they also typically use backup iron sights in case there is an issue with the primary optic as they are simple, non-electronic mechanical devices not prone to failure. Backup iron sights usually have a flip-up design so that they are out of the way when not needed, but can be flipped up if needed. A significant issue that has developed is increased use of other devices on rifles such as visible\IR lasers, visible\IR lights, laser rangefinders, night vision attachments, etc., that have diminished the amount of available space on the top of the rifle. An optic mount is a necessary means of attaching a red dot sight or a scope to the firearm and the backup iron sights provide an important secondary option. However, the optic mount itself also takes up space on the rifle.

For the foregoing reasons, there is a need for an alignment guidance system for a firearm that addresses the shortcomings associated with conventional sighting systems. In particular, there is a need for an alignment guidance system that assists a user in accurately shooting a firearm while reducing the size of the guidance system. Additionally, there is a need for an alignment guidance system for use with firearms that reduces the time required for a user to align an intended target during operation.

BRIEF SUMMARY OF THE DISCLOSURE

In accordance with the subject disclosure, there is provided an alignment guidance system for a conventional firearm.

In accordance with an exemplary embodiment of the subject disclosure, there is provided a rear sight for a firearm comprising an aperture frame securable to an upper surface of a rear end of a firearm and including opposed vertical sidewalls, and at least one planar aiming reference member extending inwardly from the aperture frame.

According to an aspect, the at least one planar aiming reference member comprises a pair of substantially horizontal planar aiming reference members extending inwardly from the vertical sidewalls and defining a gap therebetween. According to another aspect, the aperture frame further comprises a top wall connected to the vertical sidewalls. According to another aspect, the aperture frame defines a square, rectangular or octagonal central aperture. According to another aspect, the aperture frame is square, rectangular or octagonal in shape. According to another aspect, the aperture frame further comprises a base for releasably securing the aperture frame to a rear end of a firearm. According to another aspect, the base is dovetail shaped.

According to an aspect, the at least one planar aiming reference member is vertical and extends upwardly from a central region of a base of the aperture frame.

According to an aspect, a rear edge of the at least one planar aiming reference member includes a device for enhancing visibility thereof. According to another aspect, the device for enhancing visibility of the rear edge of the at least one planar aiming reference member is selected from the group consisting of brightly colored paint or plastic, fiber optics, and self-luminous materials.

In accordance with another exemplary embodiment of the subject disclosure, there is provided a firearm including a front sight and a rear sight. The front sight is disposed on an upper surface of a front end of the firearm. The rear sight includes an aperture frame securable to an upper surface of a rear end of a firearm and including opposed vertical sidewalls, and at least one planar aiming reference member extending inwardly from the aperture frame.

According to an aspect, the front sight includes a rearwardly facing aiming point alignable with the at least one planar aiming reference member. According to another aspect, the aiming point includes a device for enhancing visibility thereof. According to another aspect, the device for enhancing visibility of the aiming point is selected from the group consisting of brightly colored paint or plastic, fiber optics, and self-luminous materials.

In accordance with another exemplary embodiment of the subject disclosure, there is provided a combined sight and optic sight mount securable to an upper surface of a firearm comprising an aperture frame including a stationary aft aperture frame, and a movable aft aperture sub-frame situated within the stationary aft aperture frame. The movable aft aperture sub-frame comprises opposed vertical sidewalls, a top wall connecting the opposed vertical sidewalls, and a pair of substantially horizontal planar aiming reference members extending inwardly from the vertical sidewalls and defining a gap therebetween.

According to an aspect, the combined sight and optic sight mount further comprises an upper surface configured to releasably receive an optic sight. According to another aspect, the aperture frame further comprises a stationary fore aperture frame including a central vertical planar aiming reference member adapted to align with the gap between the pair of substantially horizontal planar aiming reference members of the movable aft aperture sub-frame.

In accordance with the subject disclosure, there is provided a method of operating an alignment guidance system with a conventional firearm.

Other features and advantages of the subject disclosure will be apparent from the following more detailed description of the exemplary embodiments.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings, exemplary embodiments. It should be understood, however, that the subject application is not limited to the precise arrangements and instrumentalities shown.

DETAILED DESCRIPTION OF THE DISCLOSURE

Figure 1:
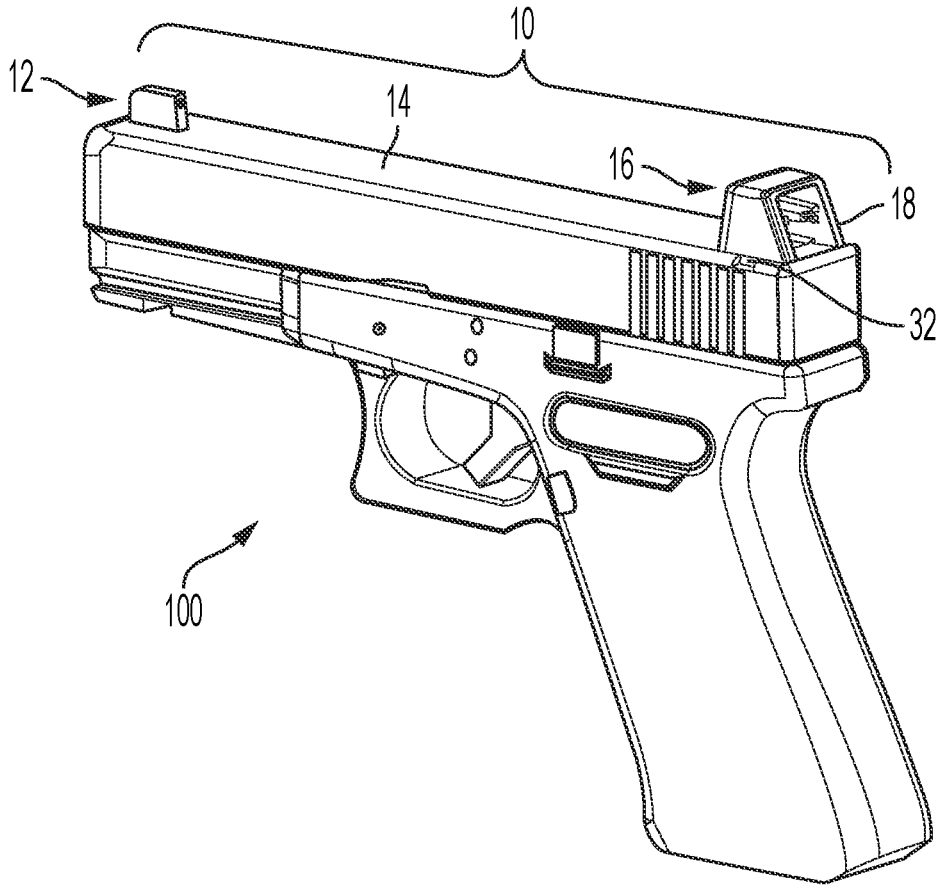
FIG. 1 a perspective view of a firearm including an alignment guidance system in accordance with an exemplary embodiment of the subject disclosure mounted thereon.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The term "anterior" means in front of the center of a body. The term "posterior" means behind the center of a body and/or away from the "anterior" end. The words "inwardly" and "outwardly" refer to directions toward and away from, respectively, the geometric center of the identified element and designated parts thereof. Such directional terms used in conjunction with the following description of the drawings should not be construed to limit the scope of the subject disclosure in any manner not explicitly set forth. Additionally, the term "a," as used in the specification, means "at least one." The terminology includes the words above specifically mentioned, derivatives thereof, and words of similar import.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or +±0.1% from the specified value, as such variations are appropriate.

"Substantially" as used herein shall mean considerable in extent, largely but not wholly that which is specified, or an appropriate variation therefrom as is acceptable within the field of art. "Exemplary" as used herein shall mean "example" only and is not intended to identify any embodiment or structure as preferred or more desirable than any other.

Throughout this disclosure, various aspects of the exemplary embodiments can be presented in a range format. It should be understood that the description in range format is merely for convenience and brevity and should not be construed as an inflexible limitation on the scope of the exemplary embodiments. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the exemplary embodiments can be practiced without one or more of the specific features or advantages of a particular embodiment. In other instances, additional features and advantages may be recognized in certain embodiments that may not be present in all exemplary embodiments of the subject disclosure.

Figure 2:
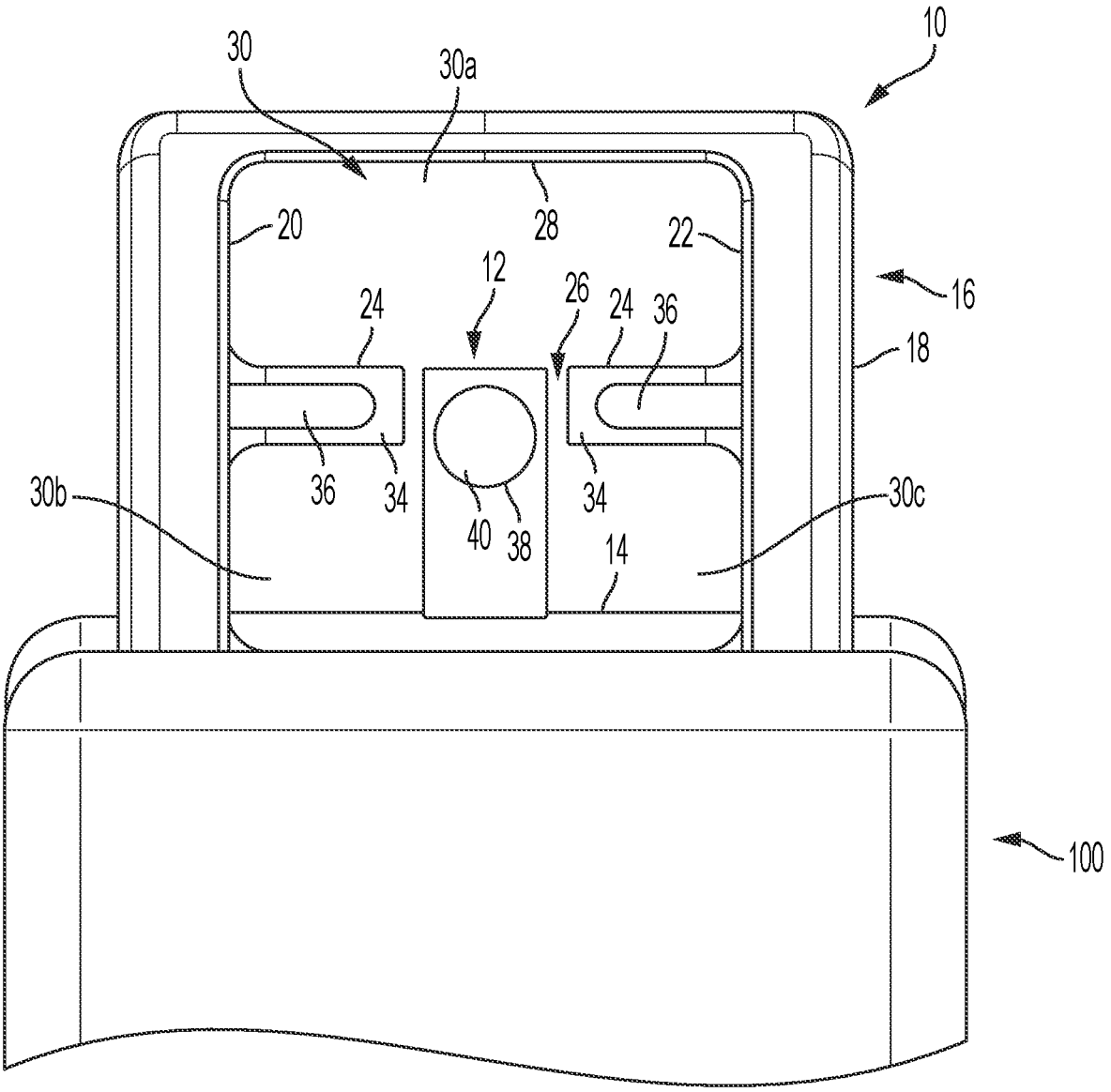
FIG. 2 is a rear view of the alignment guidance system of FIG. 1 with a front sight thereof aligned between horizontal aiming reference members of a rear sight of the alignment guidance system.
Figure 3:
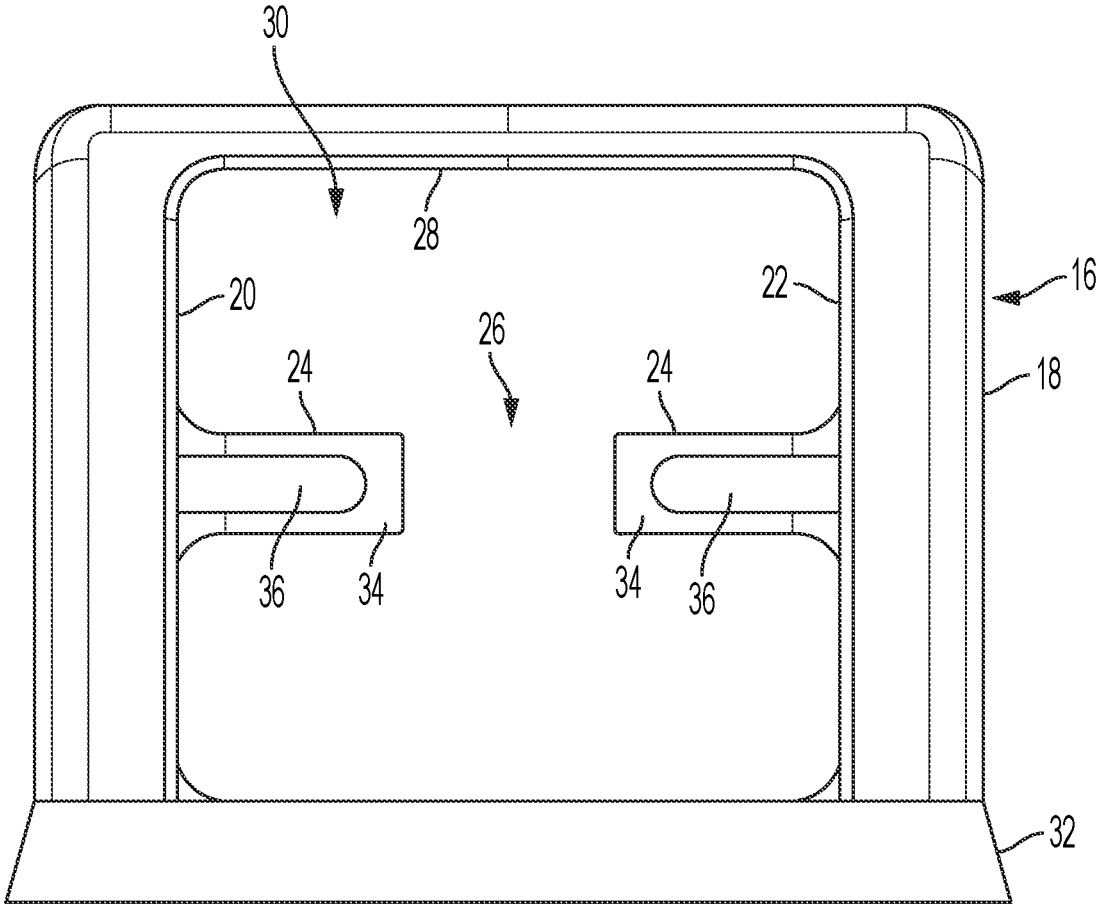
FIG. 3 is a rear view of the rear sight of the alignment guidance system of FIG. 1.

Referring to FIG. 1, the subject disclosure provides an alignment guidance system 10, i.e., a sighting system, for use with a conventional firearm 100 such as a pistol, rifle, shotgun, and the like. The alignment guidance system 10 comprises a front sight 12 disposed on an upper surface 14 of a front end of the firearm, and a rear sight 16 including an aperture frame 18 which is securable to the upper surface 14 of a rear end of the firearm 100. As best shown in FIGS. 2 and 3, the aperture frame 18 includes opposed vertical sidewalls 20, 22 and at least one planar aiming reference member 24 extending inwardly from the aperture frame for aligning with the front sight.

Referring still to FIGS. 2 and 3, in accordance with an exemplary embodiment the at least one planar aiming reference member comprises a pair of substantially horizontal planar aiming reference members 24 extending inwardly from the vertical sidewalls 20, 22 and defining a gap 26 therebetween through which the front sight 12 is visually aligned by a user. According to an aspect, the substantially horizontal planar aiming reference members 24 are substantially symmetrical.

As shown in FIGS. 1-3, the aperture frame 18 further comprises a horizontal top wall 28 connected to the vertical sidewalls 20, 22, to define a framed central aperture 30. As shown in FIGS. 2 and 3, the aperture frame 18 defines a square central aperture 30. It is contemplated, however, that the central aperture may assume other framed shapes including, without limitation, octagonal (FIG. 4) or rectangular, so long as the shape of the aperture frame includes a pair of opposed vertical sidewalls which cooperate with a horizontal top wall to define a rectilinear aperture frame for optimum visual alignment of the rear sight with the front sight along three axes, as described below. Likewise, in order to minimize the thickness of the of the walls of the aperture frame and maximize the size of the central aperture, the aperture frame can be square, rectangular, or octagonal in shape to correspond with the shape of the central aperture.

FIGS. 1 and 2 illustrate that the aperture frame 18 further comprises a base 32 for releasably securing the aperture frame of the rear sight to a rear end of a firearm. As best shown in FIG. 1, the base 32 is dovetail shaped to matingly fit within a corresponding dovetail cutout recess provided within the upper surface 14 of the firearm.

FIGS. 2 and 3 illustrate additional features of the rear sight 16. In particular, those figures show that a rear edge 34 of the at least one planar aiming reference member 24 can include a device 36 for enhancing visibility of the at least one aiming reference member. The visibility enhancing device may be any indicia or element suitable for enhancing the visibility of the at least one aiming reference member 24. According to an aspect, the device 36 for enhancing visibility of the rear edge of the at least one aiming reference member can be selected from the group consisting of brightly colored paint or plastic, fiber optics, and self-luminous materials, e.g., tritium or the like, suitable for use in in limited or no light conditions.

As best shown in FIG. 2, the front sight 12 includes a rearwardly facing aiming point 38 alignable with the gap 26 between the substantially horizontal planar aiming reference members 24. The aiming point 38 can include a device 40 for enhancing visibility of the aiming point. The visibility enhancing device 40 may be any indicia or element suitable for enhancing the visibility of the aiming point. According to an aspect, the device 40 for enhancing visibility of the aiming point can be selected from the group consisting of brightly colored paint or plastic, fiber optics, and self-luminous materials, e.g., tritium or the like.

In operation, a user first locates an intended target within the large rear aperture frame 18 of the rear sight 16. The user then refines his or her aim by aligning the aiming point 38 of the front sight 12 within the center gap 26 formed between the inwardly extending horizontal planar aiming reference members 24 of the rear aperture frame. That is, the front sight 12 should be laterally centered between the rear horizontal planar aiming reference members 24 and an upper portion, e.g., aiming point 38, of the front sight post should be aligned horizontally with upper portions of the rear horizontal planar aiming reference members. Such an alignment results in the formation of a T-shape (FIG. 2) within the rear aperture frame.

Due to the T-shape, an upper rectangular portion 30*a* and two lower smaller square portions 30*b*, 30*c* are visibly formed within the square central aperture 30 of the rear aperture frame, which creates easily identifiable reference points to facilitate proper alignment by a user during operation. The front sight 12 is desirably taller than conventional front sights. Accordingly, the horizontal planar aiming reference members 24 are correspondingly elevated above the firearm. As a result, when framed by the aperture frame 18, much of the intended target remains in view of the user, thereby providing greater confidence and awareness of the intended target during operation of the firearm 100.

In sum, a user simply centers the intended target in the rear sight aperture frame 18 using the front sight 12 and horizontal planar aiming reference members 24. Advantageously, a user intuitively can locate the planar aiming reference members without increased mental exertion.

Figure 4:
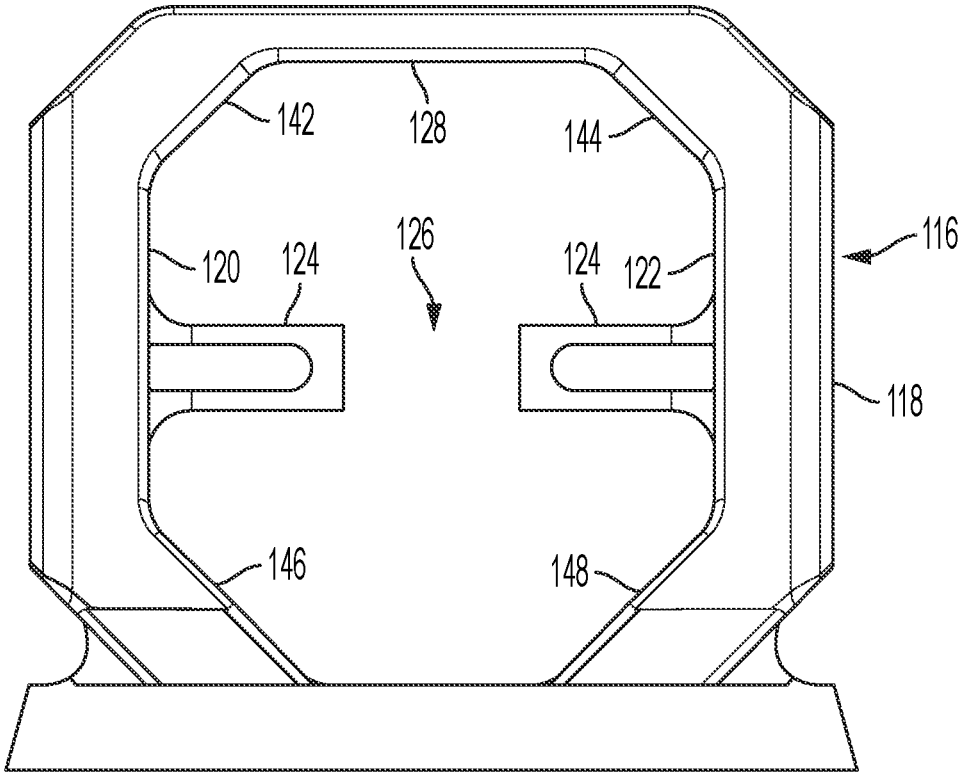
FIG. 4 is a rear view of another exemplary embodiment of a rear sight of the alignment guidance system in accordance with the subject disclosure.

Referring to FIG. 4, there is shown a rear sight 116 according to a further exemplary embodiment of the subject disclosure. The rear sight 116 corresponds in many ways to the structure and function of the rear sight 16 of FIGS. 1-3. Accordingly, those aspects of the rear sight 116 which materially depart in structure and/or function from their counterparts in FIGS. 1-3, or are otherwise necessary for a proper understanding of the subject disclosure, will be described in detail.

Unlike rear sight 16 of FIGS. 1-3 which has an aperture frame 18 that is square in shape, the rear sight 116 of FIG. 4 has an aperture frame 118 that is octagonal in shape and defines an octagonal central aperture 130. The aperture frame includes opposed vertical sidewalls 120, 122 having a pair of substantially horizontal planar aiming reference members 124 extending inwardly from the vertical sidewalls 120, 122 and defining a gap 126 therebetween through which a front sight, such as front sight 12 of FIG. 2, can be visually aligned by a user.

In addition, the aperture frame 118 further comprises a horizontal top wall 128 connected to the vertical sidewalls 120, 122 via sloped walls 142, 144, and a base 132 connected to the vertical sidewalls via sloped walls 146, 148, to define the octagonal shaped framed central aperture 130.

Figure 5:
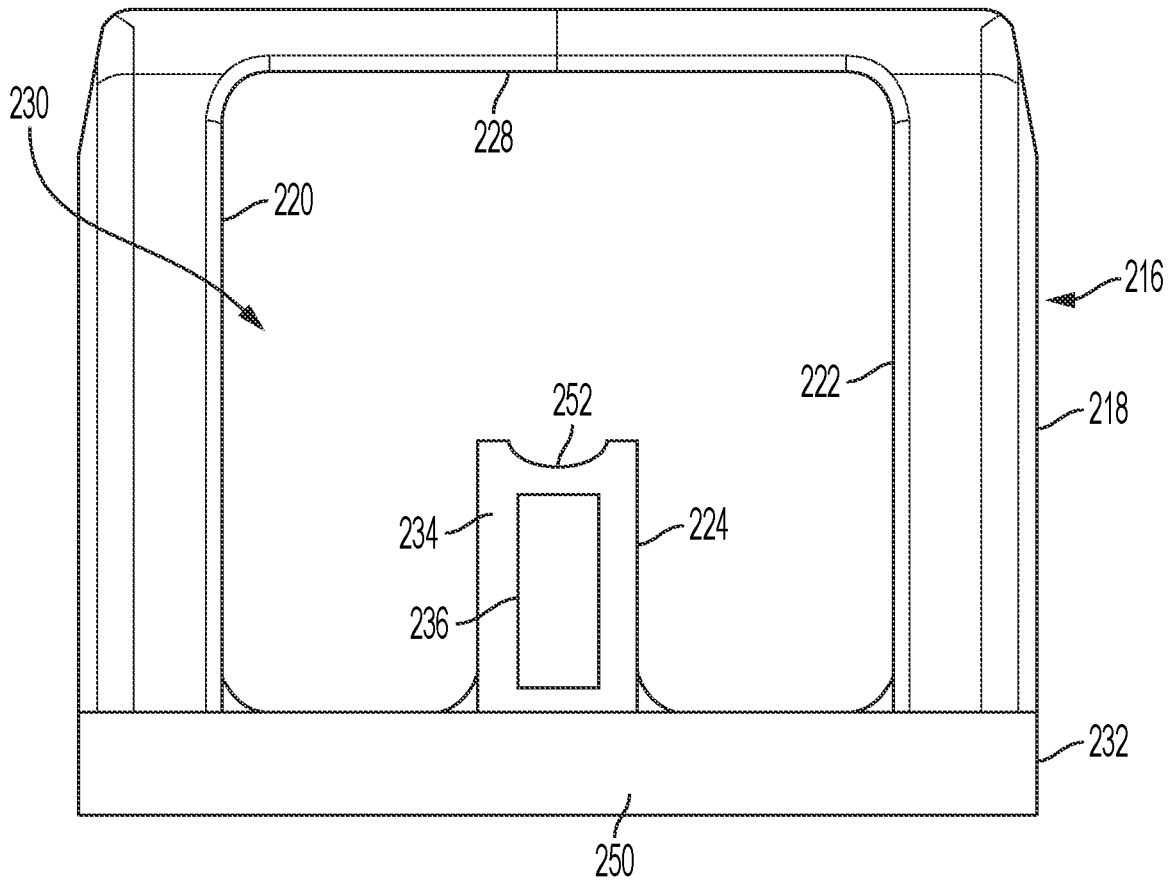
FIG. 5 is a rear view of another exemplary embodiment of a rear sight of the alignment guidance system in accordance with the subject disclosure.

Referring to FIG. 5, there is shown a rear sight 216 according to a further exemplary embodiment of the subject disclosure. The rear sight 216 includes an aperture frame 218 which is square in shape with opposed vertical sidewalls 220, 222 connected by a horizontal top wall 228 to define a square central aperture 230. It is contemplated, however, that the central aperture may assume other framed shapes including, without limitation, octagonal or rectangular, so long as the shape of the aperture frame includes a pair of opposed vertical sidewalls which cooperate with a horizontal top wall to define a rectilinear aperture frame.

As shown in FIG. 5, the rear sight 216 includes a single planar aiming reference member 224 which is vertical and extends upwardly from a central region 250 of a base 232 of the aperture frame 218. A top surface of the planar aiming reference member 224 can be provided with a notch 252 configured to align with a lower edge of an aiming point, such as aiming point 38 (FIG. 2), of an unillustrated front sight. In addition, a rear edge 234 of the planar aiming reference member 224 can include a device 236 for enhancing visibility of the aiming reference member. The visibility enhancing device may be any indicia or element suitable for enhancing the visibility of the planar aiming reference member 224. According to an aspect, the device 236 for enhancing visibility of the rear edge of the at least one aiming reference member can be selected from the group consisting of brightly colored paint or plastic, fiber optics, and self-luminous materials, e.g., tritium or the like.

Figure 6:
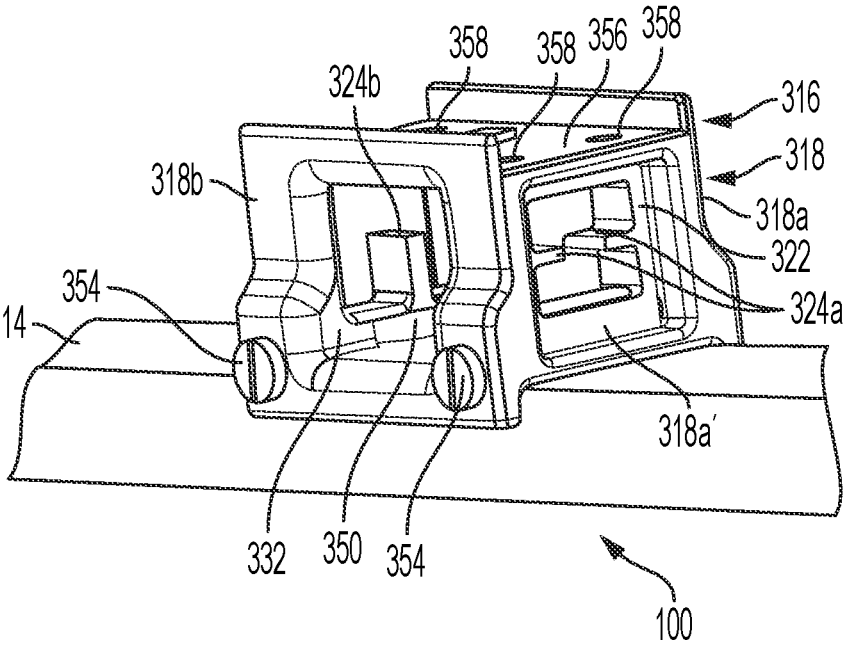
FIG. 6 is a perspective view of a combined sight and optic sight mount in accordance with the subject disclosure.
Figure 7:
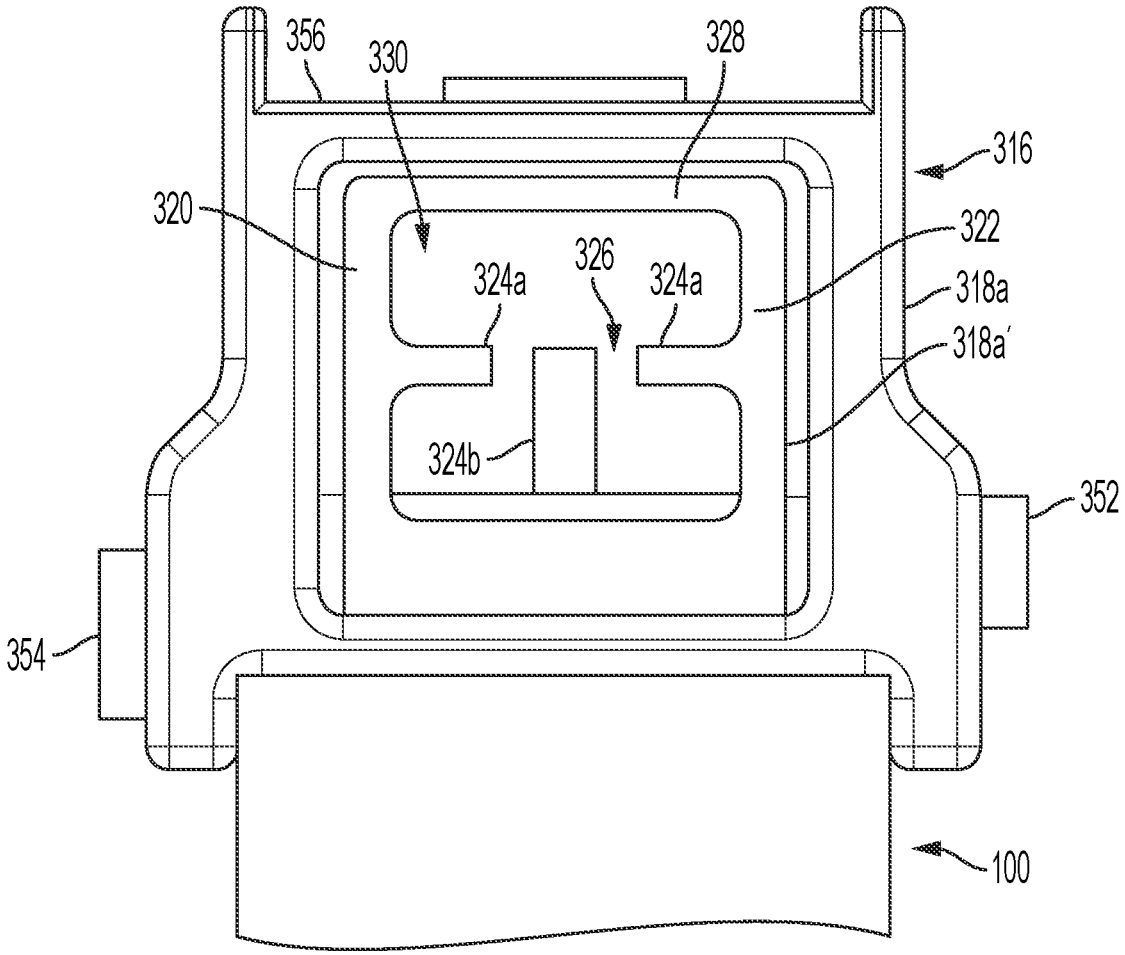
FIG. 7 is a rear view of the combined sight and optic sight mount of the alignment guidance system of FIG. 6.

Referring to FIGS. 6 and 7, there is shown a combined sight and optic sight mount 316 according to a further exemplary embodiment of the subject disclosure mounted atop an upper surface 14 of a firearm 100. The combined sight and optic sight mount 316 includes an aperture frame 318 comprising a stationary aft aperture frame 318*a*. Situated within the stationary aft aperture frame 318*a* is a movable aft aperture sub-frame 318*a*. The movable aft aperture sub-frame can be square in shape with opposed vertical sidewalls 320, 322 connected by a horizontal top wall 328 to define a square central aperture 330. It is contemplated, however, that the central aperture may assume other framed shapes including, without limitation, octagonal or rectangular, so long as the shape of the movable aft aperture sub-frame includes a pair of opposed vertical sidewalls which cooperate with a horizontal top wall to define a rectilinear aperture frame.

The movable aft aperture sub-frame 318*a*' includes a pair of substantially horizontal planar aiming reference members 324*a* extending inwardly from the vertical sidewalls 320, 322 and defining a gap 326 therebetween (FIG. 7) through which a front sight, such as front sight 12 of FIG. 2, can be visually aligned by a user. Such an arrangement finds particularly beneficial application with relatively long firearms such as rifles and shotguns. Alternatively, the combined sight and optic sight mount 316 can, as illustrated, further comprise a stationary fore aperture frame 318*b* including an optional single planar aiming reference member 324*b* which is vertical and extends upwardly from a central region 350 of a base 332 of the stationary fore aperture frame. Constructed as such, the central vertical planar aiming reference member 324*b* provided in the stationary fore aperture frame 318*b* is adapted to align with the gap 326 between the pair of substantially horizontal planar aiming reference members of the movable aft aperture sub-frame 318*a*'. In this way, the vertical planar aiming reference member 324*b* of the stationary fore aperture frame 318*b* can function as a front sight which is visually aligned by a user in the gap 326 defined by the pair of substantially horizontal planar aiming reference members 324 of the movable aft aperture sub-frame 318*a*'. Such an arrangement finds particularly beneficial application with relatively short firearms. In addition, the stationary aft aperture frame 318*a* carries an adjuster 352 (FIG. 7) which is connected to the movable aft aperture sub-frame 318*a*' to adjust the movable aft aperture sub-frame left or right within stationary aft aperture frame. The adjuster 352 thus moves the position of the gap 326 between the substantially horizontal planar aiming reference members 324*a* of the movable aft aperture sub-frame 318*a*' relative to a front sight or the vertical planar aiming reference member 324*b* of the stationary fore aperture frame 318*b* to provide for "windage" adjustment at times when wind affects aiming of the firearm.

Although not illustrated in FIGS. 6 and 7, rear edges of the planar aiming reference members 324*a*, 324*b* can include a device for enhancing visibility of the aiming reference member. The visibility enhancing device may be any indicia or element suitable for enhancing the visibility of the planar aiming reference members. According to an aspect, the device for enhancing visibility of the rear edge of the at least one aiming reference member can be selected from the group consisting of brightly colored paint or plastic, fiber optics, and self-luminous materials, e.g., tritium or the like.

The combined sight and optic sight mount 316 can include a suitable fastener or fasteners for releasably securing same to the upper surface 14 of a firearm 100. Such fastener(s) can include one or more set screws 354 which operate to releasably clamp the combined sight and optic sight mount 316 to the firearm. An upper surface 356 of the combined rear sight and optic sight mount 316 is configured to releasably receive an unillustrated optic sight such as, for example, a red dot sight or a scope. In this regard, the upper surface 356 can include a plurality of apertures 358 (FIG. 6) configured to receive fasteners for securing the optic sight to the combined sight and optic sight mount 316.

Combining a rear sight and an optic sight mount into one device saves a considerable amount of space on top of the firearm, thereby allowing the use of other devices such as visible\IR lasers, visible\IR lights, laser rangefinders, night vision attachments, etc. on the firearm. The combined rear sight and optic sight mount 316 also allows much quicker transitioning from the primary optic (e.g., red dot sight or scope) to at least the planar aiming reference members 324*a* should failure of the primary optic occur. This is because the user can quickly shift his or her focus when needed to the planar aiming reference member 324*a* which are visible within the body of the combined rear sight and optic sight mount 316. Moreover, the planar aiming reference member 324*a* and 324*b* do not need to be flipped up when needed and are out of the way of the primary optic sight when not needed.

The subject disclosure provides several distinct advantages over conventional sighting systems. For example, the subject disclosure provides a user the ability to quickly aim while the horizontal planar aiming reference points facilitate a repeatable fine point of aim which is often not possible with conventional ghost ring sights. Additionally, the sighting systems of the subject disclosure are significantly smaller than conventional red dot sights while the rear sight is slightly larger than conventional iron sights. Like iron sights, the rear sight can be removably attachable to, e.g., a slide of the firearm. Furthermore, unlike a conventional red dot sight, the alignment guidance system of the subject disclosure does not require a different slide or modification to the pre-existing slide.

Accurate operation of a firearm requires that its three axes, namely, horizontal, vertical, and longitudinal are all aligned. Centering the front sight within the rear sight frame with its vertical sidewalls and horizontal planar aiming reference members allows the horizontal and vertical axes to be aligned. Additionally, the use of a square rear sight with horizontal planar aiming reference members set at 90-degree angles from the vertical sidewalls allows a user to easily ascertain whether the horizontal planar aiming reference members are parallel. This helps the user with the longitudinal axis, or roll, of the firearm. Moreover, a square, rectangular or octagonal or other rectilinear rear sight with vertical sidewalls and horizontal planar aiming reference members along with the front sight provide necessary visual feedback to the user that facilitates keeping the firearm centered in the desired axes.

These features are especially advantageous because research shows that a user's fine motor skills rapidly deteriorate in stressful situations. Even with seasoned users of firearms, stressful situations can result in an elevated heart rate, blurred vision and significant reduction of fine motor skills. The sighting system of the subject disclosure helps alleviate such stressful situations and facilitates a user's ability to operate a firearm in such situations. Consequently, although not limited thereto, the firearm alignment guidance systems of the subject disclosure find particular beneficial use in police, military and self-defense applications.

It will be appreciated by those skilled in the art that changes could be made to the exemplary embodiments described above without departing from the broad inventive concept thereof. It is to be understood, therefore, that the subject disclosure is not limited to any particular exemplary embodiments disclosed, but it is intended to cover modifications within the spirit and scope of the subject disclosure as defined by the appended claims.

I claim:

1. A rear sight for a firearm comprising:

an aperture frame securable to an upper surface of a rear end of a firearm including opposed vertical sidewalls and defining a single square, rectangular or octagonal central aperture; and at least one planar aiming reference member extending inwardly from the aperture frame having a distal end terminating at about a center region of the aperture frame.

2. A rear sight for a firearm comprising:

an aperture frame securable to an upper surface of a rear end of a firearm including opposed vertical sidewalls and defining a single square, rectangular or octagonal central aperture; and at least one planar aiming reference member extending inwardly from the aperture frame, wherein the at least one planar aiming reference member comprises a pair of substantially horizontal planar aiming reference members extending inwardly from the vertical sidewalls and defining a gap therebetween.

3. The rear sight of claim 1, wherein the aperture frame further comprises a top wall connected to the vertical sidewalls.

4. The rear sight of claim 1, wherein the aperture frame is square, rectangular or octagonal in shape.

5. The rear sight of claim 1, wherein the at least one planar aiming reference member is vertical and extends upwardly from a central region of a base of the aperture frame.

6. A rear sight for a firearm comprising:

an aperture frame securable to an upper surface of a rear end of a firearm including opposed vertical sidewalls and defining a single square, rectangular or octagonal central aperture; and at least one planar aiming reference member extending inwardly from the aperture frame, wherein the aperture frame further comprises a base for releasably securing the aperture frame to a rear end of a firearm, and the base is dovetail shaped.

7. A rear sight for a firearm comprising:

an aperture frame securable to an upper surface of a rear end of a firearm including opposed vertical sidewalls and defining a single square, rectangular or octagonal central aperture; and at least one planar aiming reference member extending inwardly from the aperture frame, wherein a rear edge of the at least one planar aiming reference member includes a device for enhancing visibility thereof.

8. The rear sight of claim 7, wherein the device for enhancing visibility of the rear edge of the at least one planar aiming reference member is selected from the group consisting of brightly colored paint or plastic, fiber optics, and self-luminous materials.

9. A firearm comprising;

a front sight disposed on an upper surface of a front end of the firearm; and the rear sight of claim 1.

10. The firearm of claim 9, wherein the front sight includes a rearwardly facing aiming point alignable with the at least one planar aiming reference member.

11. The firearm of claim 10, wherein the aiming point includes a device for enhancing visibility thereof.

12. The firearm of claim 11, wherein the device for enhancing visibility of the aiming point is selected from the group consisting of brightly colored paint or plastic, fiber optics, and self-luminous materials.

13. A combined sight and optic sight mount securable to an upper surface of a firearm comprising:

an aperture frame including:

a stationary aft aperture frame; and a movable aft aperture sub-frame situated within the stationary aft aperture frame and comprising:

opposed vertical sidewalls, a top wall connecting the opposed vertical sidewalls, and a pair of substantially horizontal planar aiming reference members extending inwardly from the vertical sidewalls and defining a gap therebetween.

14. The combined sight and optic sight mount of claim 13, further comprising an upper surface configured to releasably receive an optic sight.

15. The combined sight and optic sight mount of claim 13, wherein the aperture frame further comprises a stationary fore aperture frame including a central vertical planar aiming reference member adapted to align with the gap between the pair of substantially horizontal planar aiming reference members of the movable aft aperture sub-frame.

16. The rear sight of claim 6, the at least one planar aiming reference member having a distal end terminating at about a center region of the aperture frame.

17. The rear sight of claim 7, the at least one planar aiming reference member having a distal end terminating at about a center region of the aperture frame.

* * * * *